US007757874B2

(12) United States Patent
Ross

(10) Patent No.: US 7,757,874 B2
(45) Date of Patent: Jul. 20, 2010

(54) FLEX SURFACE FOR HOT-FILLABLE BOTTLE

(75) Inventor: John R Ross, Broomfield, CO (US)

(73) Assignee: Ball Corporation, Broomfield, CO (US)

( * ) Notice: Subject to any disclaimer, the term of this patent is extended or adjusted under 35 U.S.C. 154(b) by 689 days.

(21) Appl. No.: 11/654,855

(22) Filed: Jan. 18, 2007

(65) Prior Publication Data

US 2008/0173613 A1 Jul. 24, 2008

(51) Int. Cl.
*B65D 1/46* (2006.01)

(52) U.S. Cl. ..... 215/381; 215/382; 220/669; 220/675

(58) Field of Classification Search ..... 215/379–384; 220/675, 666, 669
See application file for complete search history.

(56) References Cited

U.S. PATENT DOCUMENTS

| | | | | |
|---|---|---|---|---|
| 3,325,031 | A | 6/1967 | Singier | |
| 4,610,366 | A * | 9/1986 | Estes et al. | 426/106 |
| 4,946,053 | A | 8/1990 | Conrad | |
| 5,005,716 | A | 4/1991 | Eberle | |
| 5,060,453 | A | 10/1991 | Alberghini et al. | |
| 5,092,475 | A | 3/1992 | Krishnakumar et al. | |
| 5,101,990 | A | 4/1992 | Krishnakumar et al. | |
| 5,141,121 | A | 8/1992 | Brown et al. | |
| 5,178,289 | A | 1/1993 | Krishnakumar et al. | |
| 5,222,615 | A | 6/1993 | Ota et al. | |
| D344,457 | S | 2/1994 | Prevot et al. | |
| 5,303,834 | A | 4/1994 | Krishnakumar et al. | |
| 5,341,946 | A | 8/1994 | Vailliencourt et al. | |
| 5,392,937 | A | 2/1995 | Prevot et al. | |
| 5,407,086 | A | 4/1995 | Ota et al. | |
| 5,503,283 | A | 4/1996 | Semersky | |
| 5,598,941 | A * | 2/1997 | Semersky et al. | 215/384 |
| D380,685 | S | 7/1997 | Steih | |
| D382,485 | S | 8/1997 | Krishnakumar et al. | |
| D385,497 | S | 10/1997 | Krishnakumar et al. | |
| 5,704,504 | A | 1/1998 | Bueno | |
| D390,114 | S | 2/1998 | Young | |
| 5,758,790 | A * | 6/1998 | Ewing, Jr. | 215/384 |
| 5,762,221 | A | 6/1998 | Tobias et al. | |
| 5,971,184 | A | 10/1999 | Krishnakumar et al. | |
| D417,844 | S | 12/1999 | Lane | |
| 6,016,932 | A | 1/2000 | Gaydosh et al. | |
| 6,044,996 | A | 4/2000 | Carew et al. | |
| D448,303 | S | 9/2001 | Cheng et al. | |

(Continued)

*Primary Examiner*—Sue A Weaver
(74) *Attorney, Agent, or Firm*—Brinks Hofer Gilson & Lione

(57) ABSTRACT

A blow-molded bottle has a flexible concave perimeter surface extending between an upper peripheral margin projecting outward from the bottle neck and an outwardly protruding ring located above the sidewall upper margin. The flexible concave perimeter surface is specially dimensioned to respond to the presence of a vacuum within the bottle by forming linear segments between the upper peripheral margin and the outwardly protruding ring. The average radius of the vertical mid-point of the concave perimeter surface is generally greater than $(3/\pi)$ $(\sin \pi/3)$ $(R_1+R_2)$, and less than $(6/\pi)$ $(\sin \pi/6)$ $(R_1+R_2)$, where $R_1$ is the outermost radius of the upper peripheral margin, and $R_2$ is the radius of the outwardly protruding ring. The vertical midpoint radius of the flexible concave perimeter surface measured from the vertical axis can be made to vary by between one and five percent at between three and five positions around the perimeter.

21 Claims, 6 Drawing Sheets

U.S. PATENT DOCUMENTS

| | | | | |
|---|---|---|---|---|
| 6,398,052 | B1 | 6/2002 | Cheng et al. | |
| 6,520,362 | B2 * | 2/2003 | Heisel et al. | 215/381 |
| 6,554,146 | B1 | 4/2003 | DeGroff et al. | |
| 6,585,125 | B1 | 7/2003 | Peek | |
| 6,595,380 | B2 | 7/2003 | Silvers | |
| D479,690 | S | 9/2003 | DeGroff | |
| D480,310 | S | 10/2003 | Yourist | |
| 6,662,960 | B2 | 12/2003 | Hong et al. | |
| 6,662,961 | B2 | 12/2003 | Yourist | |
| 6,698,606 | B2 | 3/2004 | Deubel et al. | |
| 6,726,044 | B1 | 4/2004 | Deubel et al. | |
| 6,779,673 | B2 | 8/2004 | Melrose et al. | |
| 6,796,450 | B2 | 9/2004 | Prevot et al. | |
| 6,830,158 | B2 | 12/2004 | Yourist | |
| 6,857,531 | B2 | 2/2005 | Slat et al. | |
| 6,896,147 | B2 | 5/2005 | Trude | |
| 6,923,334 | B2 | 8/2005 | Melrose et al. | |
| 6,942,116 | B2 | 9/2005 | Lisch et al. | |
| 7,017,763 | B2 | 3/2006 | Kelley | |
| 7,032,770 | B2 | 4/2006 | Finlay et al. | |
| 2001/0037992 | A1 * | 11/2001 | Tanabe et al. | 215/384 |
| 2003/0000911 | A1 | 1/2003 | Kelley et al. | 215/381 |
| 2004/0016716 | A1 | 1/2004 | Melrose et al. | 215/381 |
| 2004/0195199 | A1 * | 10/2004 | Maki et al. | 215/381 |
| 2004/0200799 | A1 * | 10/2004 | Yourist et al. | 215/381 |
| 2005/0051509 | A1 | 3/2005 | Bysick et al. | |
| 2006/0289378 | A1 * | 12/2006 | Zhang | 215/381 |

* cited by examiner

FLEX SURFACE FOR HOT-FILLABLE BOTTLE

BACKGROUND OF THE INVENTION

The present invention relates to blow-molded bottles, typically made of a plastic such as polyethylene terephthalate (PET), useful in containing beverages that are hot-filled into the bottles. The present invention relates particularly to a structure for a surface portion, particularly the shoulder portion, of such bottles useful to at least partially compensate for any post capping vacuum within the bottle.

Plastic blow molded bottles intended to be hot-filled have previously been provided with a variety of features intended to at least partially compensate for the post-capping development of a partial vacuum within the bottle upon cooling of the contents. For example, U.S. Pat. Nos. 5,005,716; 5,503,283; 6,595,380; 6,896,147; 6,942,116; and 7,017,763 disclose blow molded bottles that can be used in hot-fill operations, which include features in the base of the bottle intended to at least partially compensate for the post capping development upon cooling of a partial vacuum. U.S. Pat. Nos. 5,092,475; 5,141,121; 5,178,289; 5,303,834; 5,704,504; 6,398,052; 6,585,125; 6,698,606; and 7,032,770 disclose blow molded bottles that can be used in hot-fill operations, which include features in the side wall of the bottle intended to at least partially compensate for the post capping development of a partial vacuum. U.S. Pat. Nos. 5,222,615; 5,762,221; 6,044,996; 6,662,961; and 6,830,158 disclose blow molded bottles that can be used in hot-fill operations, which include features in the shoulder of the bottle intended to at least partially compensate for the post capping development upon cooling of a partial vacuum.

U.S. Pat. Nos. 5,392,937; 5,407,086; 5,598,941; 5,971,184; 6,554,146; and 6,796,450 disclose blow molded bottles that can be used in hot-fill operations, which include axially rotationally symmetric shoulders between a side wall and a neck of each bottle. The shoulders of these bottles have a circumferentially continuous outwardly extending upper margin adjoining the neck, an outwardly protruding ring immediately above the side wall, and a concave perimeter surface joining the upper margin to the outwardly protruding ring. This shoulder structure is sometimes described as one that is convenient for grasping the bottle, and has been recognized in U.S. Pat. No. 6,016,932 as possibly contributing to poor top load capabilities. There is not been any recognition that such a substantially axially rotationally symmetric concave perimeter surface could be useful in at least partially compensating for the post capping partial vacuum within the bottle.

Despite the various features and benefits of the structures of the forgoing disclosures, there remains a need for alternative geometries for bottle that can be hot filled and have a substantially axially rotationally symmetric geometry that can accommodate the post capping development of a partial vacuum within the bottle. There further remains a need for such a bottle having a substantially axially rotationally symmetric geometry that effectively resists ovalization of the sidewall. There is a further need for such a bottle that will uniformly conform to a specified geometry following hot filling so that the bottles will have a uniform appearance at the time of customer selection and purchase.

SUMMARY OF THE INVENTION

These several needs are satisfied by a blow-molded bottle having a base, a side wall extending upward from the base including a lower sidewall margin and an upper sidewall margin, a shoulder portion extending upward and axially inward above the upper margin of the side wall to a finish defining a opening adapted to accept a closure. The shoulder includes a circumferentially continuous outwardly extending surface adjoining the neck that terminates in an upper peripheral margin. An outwardly protruding ring is located below the upper peripheral margin of the shoulder and above the sidewall upper margin. A flexible concave perimeter surface joins the upper peripheral margin of the shoulder to the outwardly protruding ring. The flexible concave perimeter surface of the shoulder is specially dimensioned to responding to the presence of a vacuum within the bottle by forming linear segments between the upper peripheral margin and the outwardly protruding ring. The linear segments that form as a result of the vacuum within the bottle are separated from each other by concave indented portions that at least partially compensate for the post capping development of a partial vacuum. A flexible concave perimeter surface of the present invention joining an upper peripheral margin to a lower outwardly protruding ring can be included in areas of the bottle other than the shoulder, and more than one such surfaces can be included in a single bottle.

The average radius of the vertical mid-point of the concave perimeter surface, measured from the vertical axis, is generally between about 82% and 96% of the average of the two radii defining the upper peripheral margin and the outwardly protruding ring, which are the vertical limits of the concave perimeter surface. The average mid-point radius of the concave surface is generally greater than $(3/\pi)(\sin \pi/3)(R_1+R_2)$, where $R_1$ is the outermost radius of the upper peripheral margin above the concave perimeter surface, and $R_2$ is the radius of the outwardly protruding ring defining the lower margin of the concave perimeter surface. The radius of the vertical mid-point of the concave perimeter surface is generally no more than $(6/\pi)(\sin \pi/6)(R_1+R_2)$. The entire flexible concave perimeter surface can be at a radius greater than either the outwardly extending upper peripheral margin or the outwardly protruding ring, but not both. The development of the linear segments can be assisted by dimensioning the vertical midpoint of the flexible concave perimeter surface so that the vertical midpoint radius measured from the vertical axis varies by between one and five percent at between three and five positions around the concave surface perimeter.

The blow molded bottle can include features other than the flexible concave surface to accommodate the post capping development of a vacuum upon cooling. For example, the side wall and the base can include vacuum responsive features such as panels surrounded by flexible rings more or less like those typically found in the prior art. The side wall can also include one or more upper steps or other features defining an upper margin of a label panel and one or more lower steps or other features defining a lower margin of the label panel. The label panel portion of the side wall can include at least one continuous or discontinuous, inwardly indented or outwardly extending hoop ring to inhibit ovalization of the side wall. An inwardly indented ring can be used to join the upper margin of the side wall to the shoulder portion. The radius of the inwardly indented ring measured from the vertical axis of the bottle can be about equal to the average radius of the vertical midpoint of the concave perimeter surface.

One feature of the present invention is the use of a vacuum responsive surface that is substantially rotationally symmetric about the axis of the bottle when the bottle is not under a post capping vacuum. When under a post capping vacuum, this substantially rotationally symmetric surface assumes a modified appearance containing a plurality of linear segments conforming to a specified geometry so that, at the time of customer selection and purchase, all bottles of the same construction and filled under similar circumstances can have a uniform appearance.

Other features of the present invention and the corresponding advantages of those features will be come apparent from the following discussion of the preferred embodiments of the present invention, exemplifying the best mode of practicing the present invention, which is illustrated in the accompanying drawings. The components in the figures are not necessarily to scale, emphasis instead being placed upon illustrating the principles of the invention. Moreover, in the figures, like referenced numerals designate corresponding parts throughout the different views.

DESCRIPTION OF A PREFERRED EMBODIMENT

Figure 1:
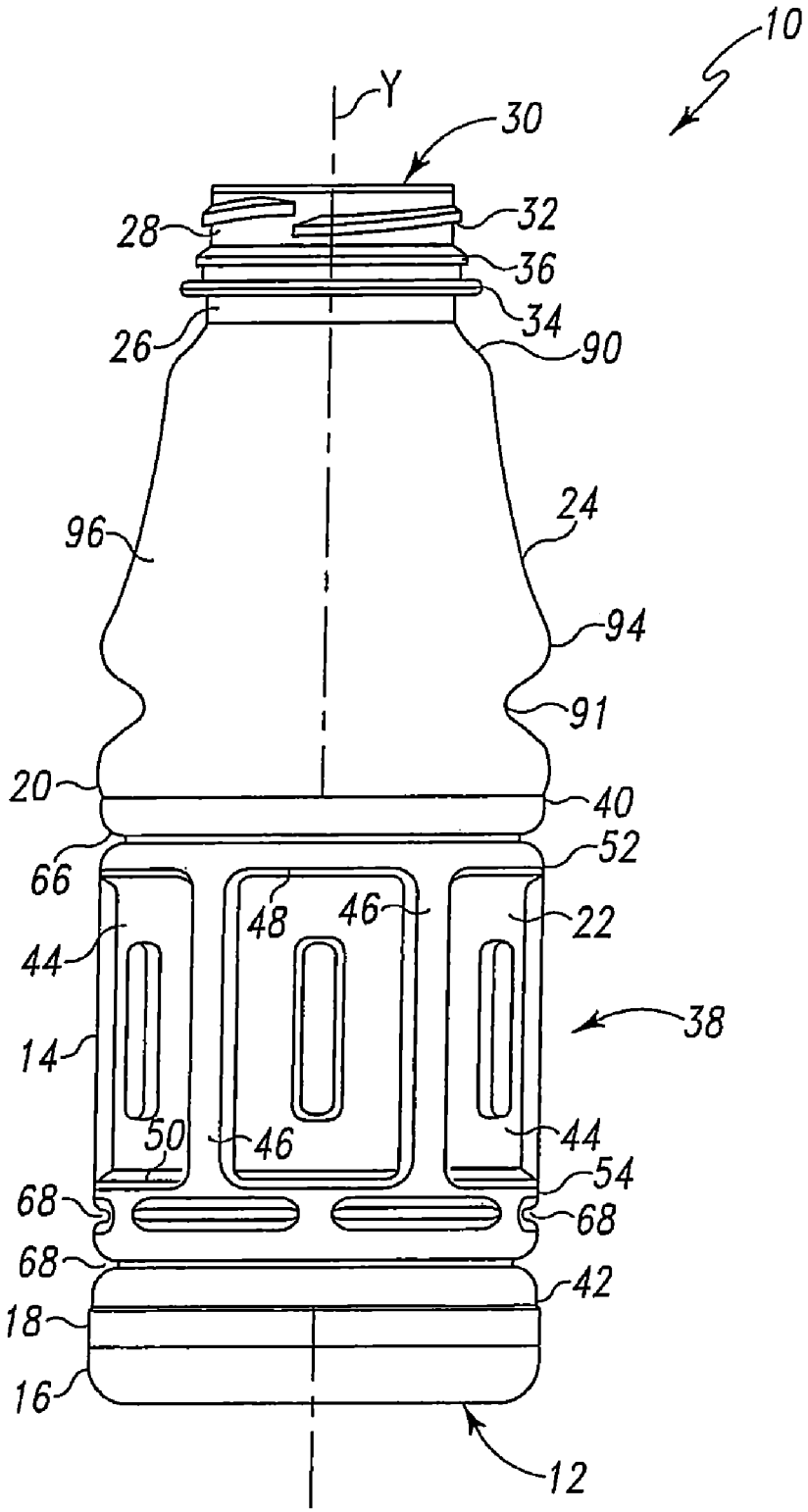
FIG. 1 is a side elevation view of a bottle embodying the present invention.

A blow-molded bottle 10 is shown in FIG. 1 representing a first embodiment of the present invention. The bottle 10 has a base 12 on which the bottle rests on any underlying supporting surface, not shown. A side wall 14 extending upward from a heel portion 16 coupling the base 12 to the side wall 14. The side wall 14 generally includes a lower margin 18 joined integrally to the heel portion 16 and an upper margin 20. The side wall 14, between the lower margin 18 and the upper margin 20, can be generally circularly symmetric about vertical axis Y passing through the center of the bottle 10. The side wall 14 can include a variety of features including features 22 described in detail below that are intended to be responsive to any development of a vacuum within the bottle 10 that might otherwise cause distortion of the sidewall 14. A shoulder portion 24 extends upward and axially inward above the upper margin 20 of the side wall 14 to a neck 26 supporting a finish 28 defining an opening 30, the finish 28 being adapted to accept a closure, not shown. The finish 28 is illustrated to include a helical thread 32 designed to receive a comparably threaded closure, but the finish 28 could include other closure engaging features such as a crown ring suitable for engagement with a conventional metal deformable crown cap or other closure, not shown. The illustrated bottle 10 also includes a support ring 34 at the upper margin of the neck 26 and an engaging ring 36 for engaging a pilfer-indicating ring of a threaded cap.

The side wall 14 of the blow-molded bottle 10 can be formed to include a variety of configurations that may include features for intended to compensate in part for the development of any post capping vacuum within the bottle. For example, the container 10 can have the features shown in FIG. 1 wherein the side wall 14 has a label mount area 38 bounded generally by a step defining an upper edge 40 and another step defining a lower edge 42. A plurality of generally vertically oriented, parallel vacuum panels 44, are situated in the label mount area 38 with a vertical post 46 separating each adjacent pair of vacuum responsive panels 44 that are intended to flex inwardly to at least partially compensate for the post capping development of a partial vacuum within the bottle 10. An upper ledge 48 and a lower ledge 50 define the vertical ends of each of the vacuum panels 44. The upper ledge 48 is spaced from the upper edge step 40 by a cylindrical surface portion 52. Similarly, the lower ledge 50 is spaced from the lower edge step 42 by a cylindrical surface portion 54. The upper and lower cylindrical surface portions 52 and 54 are of equal radius from the axis Y, and can be employed to receive a label, not shown, within the edges 40 and 42 of the label mount area 38. The upper and lower cylindrical surface portions 52 and 54, taken together with the outer surface of the vertical posts 46, form a substantially continuous surface of constant radius from the axis Y. The vertical post 46 provided between each pair of adjacent vacuum panels 44 can include stiffening ribs, not shown. The posts 46 can have a width that can be between about 5° and 15° of arc measured from the Y axis. At least one indented ring 66 can situated in the upper cylindrical surface portion 52 between the upper edge step 40 of the label mount area 38 and the upper ledge 48 of the vacuum panels 44. Other indented rings 68 can be situated in the lower cylindrical surface portion 54 between the lower edge step 42 of the label mount area 38 and the lower ledge 50 of the vacuum panels 44. The indented ring 66 and one of the indented rings 68 are shown to be circumferentially continuous, while another of the indented rings 68 is shown to be segmented or circumferentially discontinuous, however the rings can be of the same character or can be positionally swapped from that shown without any substantial change in performance of the bottle 10.

Figure 2:
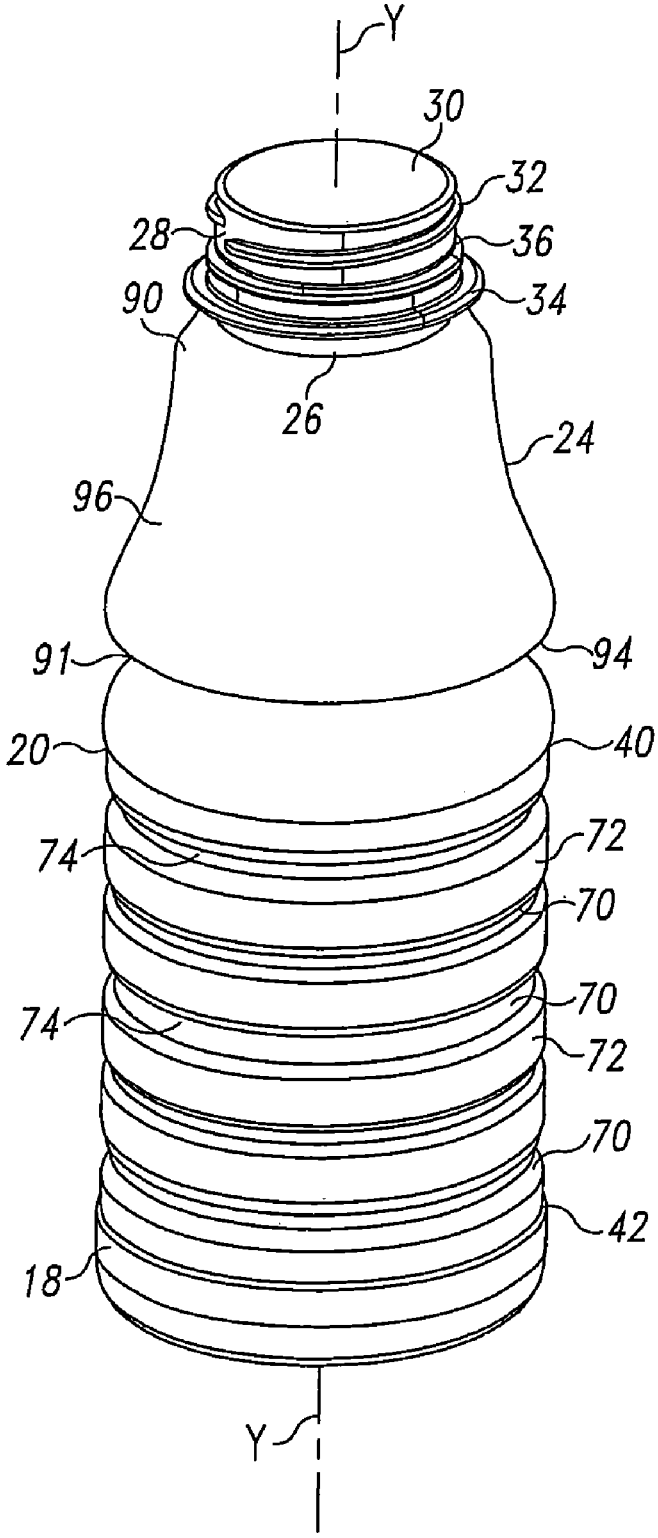
FIG. 2 is a perspective view of another bottle embodying the present invention.

An alternative structure for the label mount area 38 of bottle 10 is shown in FIG. 2 wherein the sidewall includes a plurality of grooves 70, which can be of varying vertical and radial dimensions and which are separated by panels 72. The upper and lower cylindrical surface portions 52 and 54 of the label mount area 38 and the panels 72 between the grooves 70 are generally of equal radius from the axis Y of the bottle 10 when initially formed. Like the first embodiment, a label, not shown, can be applied to the bottle 10 so that the label completely surrounds the bottle. Some modest radially inward movement of the vertical midpoint of each groove ridge portion 74 can also occur, but little or no vertical shortening of the label mount area 38 occurs. As a result, the overall dimensions of the label mount area 38 remain substantially unchanged despite the presence of the vacuum within the bottle 10, yet some modest compensation for that vacuum can occurs by virtue of the flexing of each groove 70. The majority of the vacuum compensation is believed to occur in the shoulder area 24.

Figure 3:
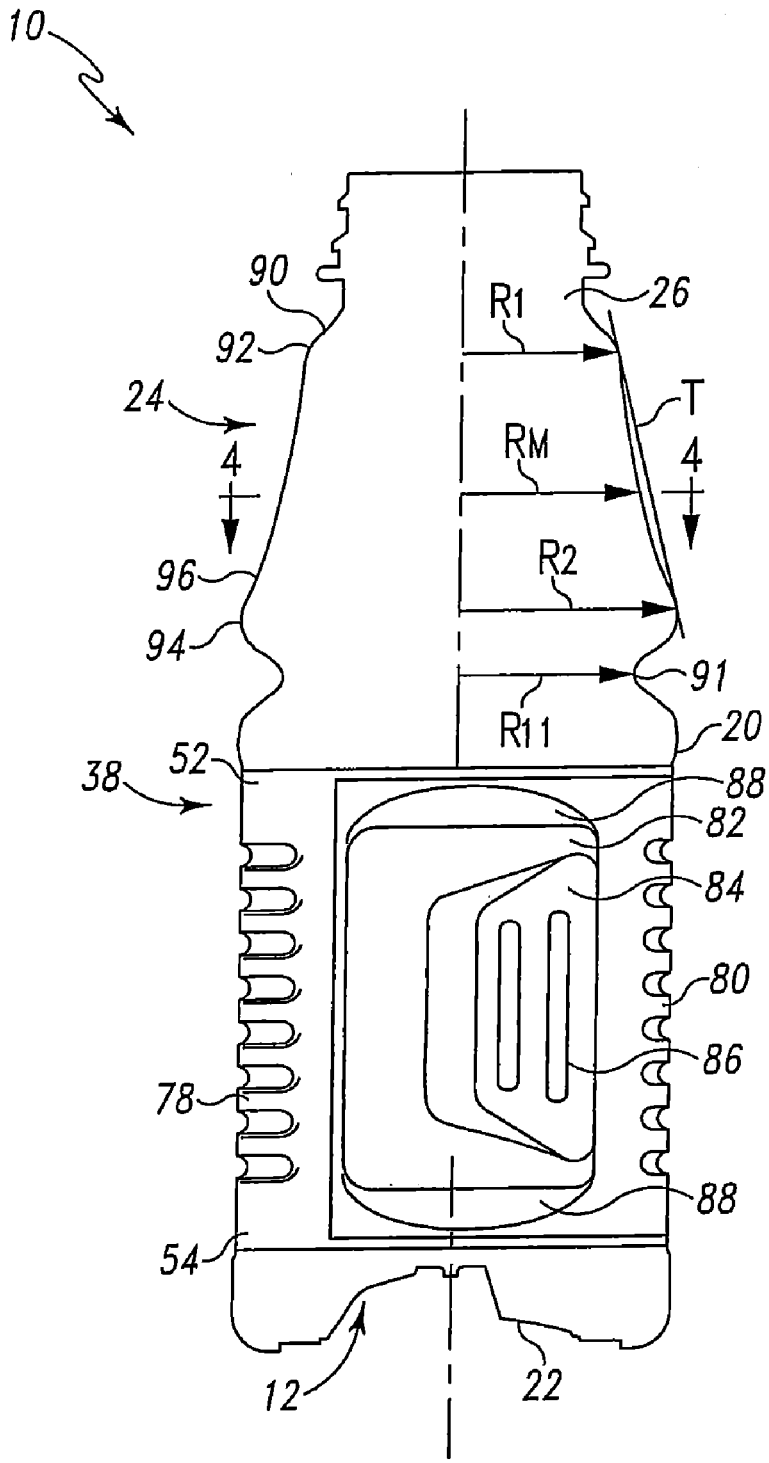
FIG. 3 is a side elevation view, partially in section, of another bottle embodying the present invention.

A further alternative structure for the label mount area 38 of bottle 10 is shown in FIG. 3 that includes an arcuate front label panel 78 which extends between upper and lower cylindrical surface portions 52 and 54 of the label mount area 38. An arcuate rear palm panel 80 is located diametrically opposite the front label panel 78 that extends likewise between upper and lower cylindrical surface portions 52 and 54 of the label mount area 38. A pair of flex panels 82 are set inwardly from, and extend between, the upper edge 40 and the lower edge 42 on opposite sides of the bottle 10. The flex panel 82 extends between the front label panel 78 and rear palm panel 80. Unlike the first two embodiments, the presence of the flex panels 82 generally precludes the use of a single label that could completely surround the bottle 10. Each flex panel 82 has formed therein a more or less rigid grip structure 84 for receiving a person's thumb and fingers on opposite sides of the bottle 10 when the palm panel 80 is engaged by the person's palm. The grip structures 84 are deeper closer to the front label panel 78 than to the rear palm panel 80 and are formed to resist inverting in response to changes in volume of the liquid within the bottle 10. Each of the flex panels 82 can have a substantially rectangular elevational configuration with its lengthwise dimension being disposed vertically as shown in FIG. 3. Vertical stiffening ribs 86 can extend lengthwise of each flex panel 82 between the adjacent the front label panel 78 and the rear palm panel 80. Each flex panel 82 can have upper and lower chordal stiffening panels 88 extending horizontally between the front and rear panels 78, 80. Each flex panel 82, as manufactured, can have a slightly outwardly-bowed convex configuration so that when filled, closed, and cooled, the flex panels 82 can flex inwardly to at least partially offset the developing vacuum within the bottle 10 without effecting unwanted distortion of the bottle. The base 12 of the bottle 10 can include additional features 22 that may also partially offset the developing vacuum.

The label panels shown in FIGS. 1-3 are intended as merely examples of possible configurations for bottles 10 that can be constructed in accordance with the present invention, and are not intended to exhaust the possible shapes for the label panel portion of the bottle 10. The shoulder portion 24 as shown in all of the illustrated embodiments generally includes a circumferentially continuous surface 90 extending outwardly from the neck 26 to an upper peripheral margin 92. An outwardly protruding ring 94 is located below the upper peripheral margin 92 and above the upper margin 20 of the sidewall 14. A flexible concave perimeter surface 96 joins the upper peripheral margin 92 of the shoulder 24 to the outwardly protruding ring 94. An inwardly indented ring 91 can separate the outwardly protruding ring 94 from the upper sidewall margin 20. As shown in FIG. 3, the upper peripheral margin 92 is situated a radius $R_1$ from the vertical axis Y of the bottle 10. The outwardly protruding ring 94 is shown situated at a larger radius $R_2$. The surface 96 of the shoulder 24 is shown to be concave as compared to a line T that is drawn tangent to both the upper peripheral margin 92 and the outwardly protruding ring 94. At a vertical midpoint, half way between the two radii $R_1$ and $R_2$, a further radius $R_M$ can be constructed from the axis Y to the surface 96. It has been found that by limiting the dimension of the average midpoint radius $R_M$, the surface 96 will respond to the presence of a vacuum within the bottle 10 in particularly desirable ways. The radius $R_{II}$, of the inwardly indented ring 91 measured from the vertical axis Y of the bottle 10 is shown to be about equal to the average radius $R_M$ of the vertical midpoint of the concave perimeter surface 96.

Figure 4:
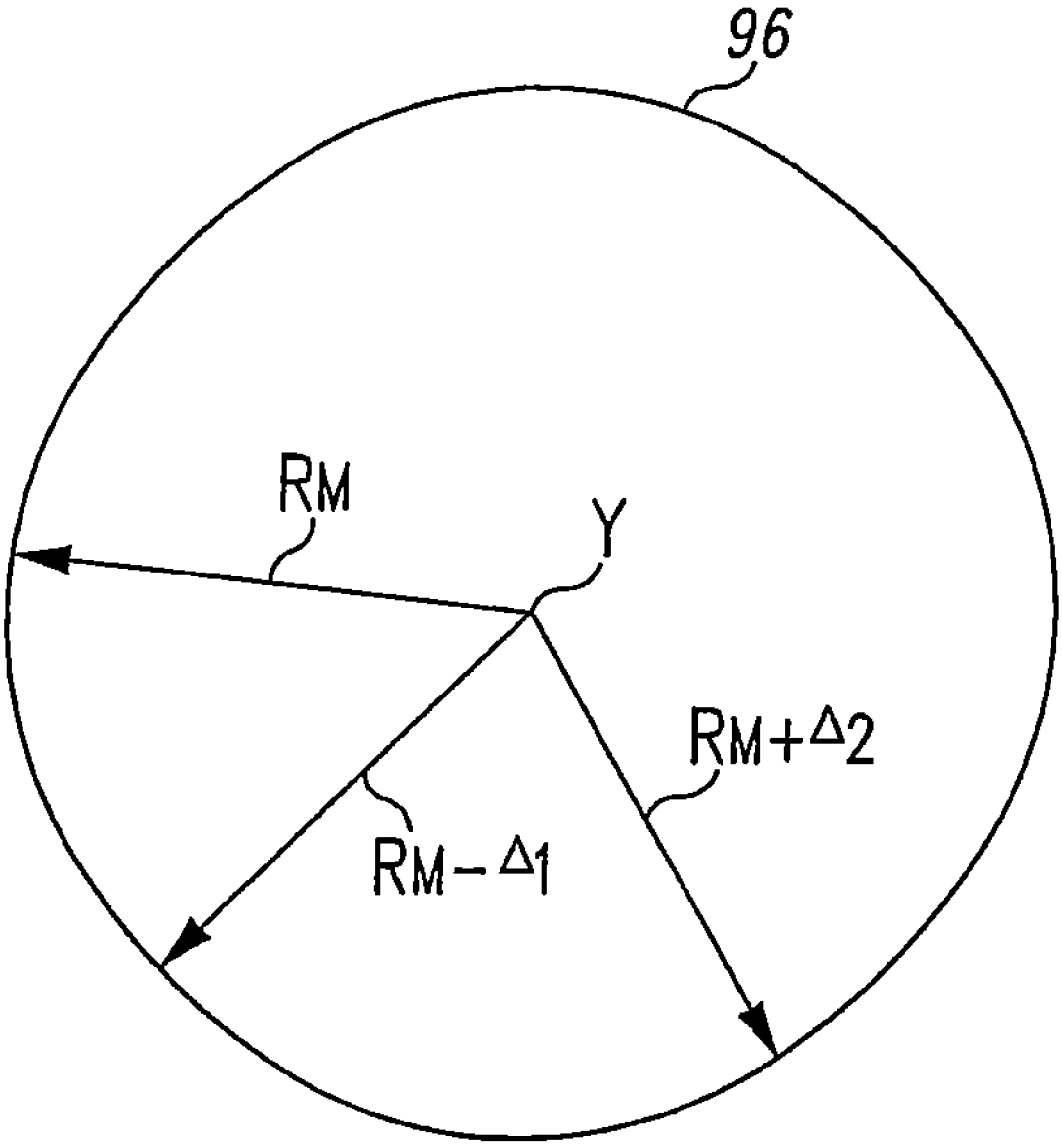
FIG. 4 is a sectional slice taken along line 4-4 in FIG. 3 of a bottle of the present invention prior to post capping vacuum deformation.
Figure 5:
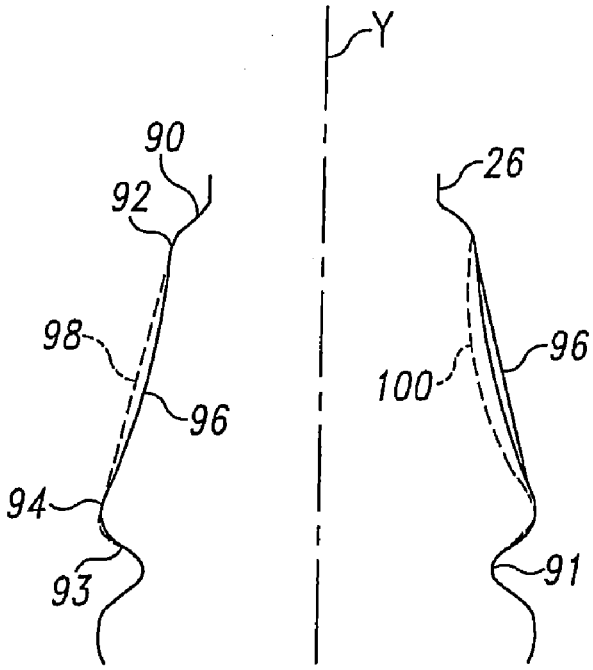
FIG. 5 is a diagrammatic view of the shoulder of any of the bottles shown in FIGS. 1-3 showing the deformations of the shoulder when subjected to post capping vacuum development within the bottle.

In one preferred embodiment, the flexible concave perimeter surface 96 has an average midpoint radius $R_M$ that is at least equal to $0.82\times(R_1+R_2)/2$, and is no greater than $0.96\times(R_1+R_2)/2$. Additionally, the midpoint radius $R_M$ varies in dimension at selected equally spaced points around the perimeter of the surface 96 by between one and five percent at between three and five positions as shown in FIG. 4. The variation in dimension causes the surface 96 to have a minimum radius of $R_M-\Delta_1$ and a maximum radius of $R_M+\Delta_2$. The variations in radius $\Delta_1$ and $\Delta_2$ can be of equal absolute value. When the concave perimeter surface 96 is so dimensioned, the presence of a developing vacuum within the bottle 10 causes the surface to reconfigure in a predictable manner by forming linear segments 98 between the upper peripheral margin 92 and the outwardly protruding ring 94 as shown, for example, by the dotted line on the left side of FIG. 5. The linear segments 98 that form as a result of the vacuum within the bottle are separated from each other by concave indented portions 100, as shown, for example, by the dotted line on the right side of FIG. 5. The alternating linear segments 98 and concave portions 100 around the perimeter of surface 96 due to the vacuum within the bottle 10 can cause a vertical wavy appearance to develop in the upper wall 93 of the inwardly indented ring 91 joining the sidewall upper margin 20 to the shoulder portion 24. The concave indented portions 100 can at least partially compensate for the post capping development of a partial vacuum within the bottle 10. Upon opening the bottle 10 the partial vacuum is released allowing the bottle to nearly reassume its original configuration.

Figure 6:
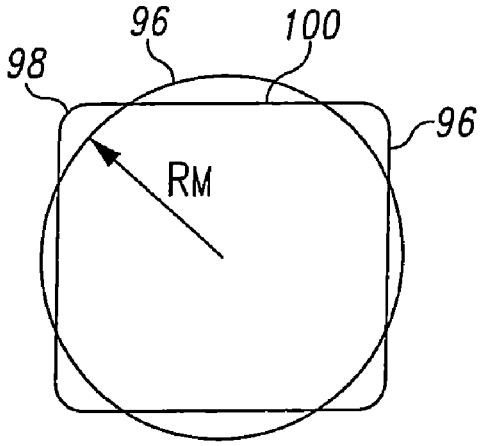
FIG. 6 is a section slice similar to FIG. 4 showing the deformation of the shoulder of a first bottle of the present invention when subjected to post capping vacuum development within the bottle.

For example, a bottle having a shoulder 24 similar to that shown in FIGS. 1-3 was made that had a radius $R_1$ for the upper peripheral margin equal to 2.591 cm. The example bottle had a radius $R_2$ for the outwardly protruding ring equal to 3.660 cm. The average of these two radii $(R_1+R_2)/2$ is equal to 3.124 cm. The example bottle was formed so that the average midpoint radius $R_M$ was equal to 2.943 cm, which is equal to about $0.94\times(R_1+R_2)/2$. The surface 96 of the example bottle was formed so that the midpoint radius $R_M$ varied between a minimum $R_M-\Delta_1$ of 2.917 cm and a maximum $R_M+\Delta_2$ of 2.968 cm. This variation in midpoint radius was repeated around the perimeter of the shoulder four times so that in cross-section, the configuration generated by the midpoint radius $R_M$ was very nearly circular as shown in FIG. 4 so that the concave peripheral surface 96 is substantially rotationally symmetric about the axis Y of the bottle 10 when the bottle is not under a post capping vacuum. When the example bottle was hot-filled, capped and cooled, the surface 96 assumed an alternating linear and concave configuration as discussed in connection with FIG. 5, and the vertical midpoint of the concave perimeter surface 96 assumed a rounded corner square cross-sectional configuration as shown in FIG. 6. Additionally, an upper wall 93 of the inwardly indented ring 91 joining the upper margin 20 of the side wall to the shoulder portion 24 can have a vertically wavy appearance that may be enhanced in response to the presence of a vacuum within the bottle 10.

Figure 7:
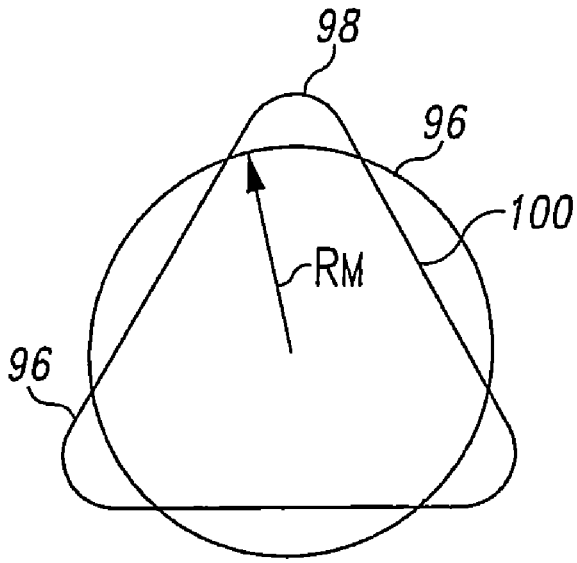
FIG. 7 is a section slice similar to FIG. 4 showing the deformation of the shoulder of a second bottle of the present invention when subjected to post capping vacuum development within the bottle.
Figure 8:
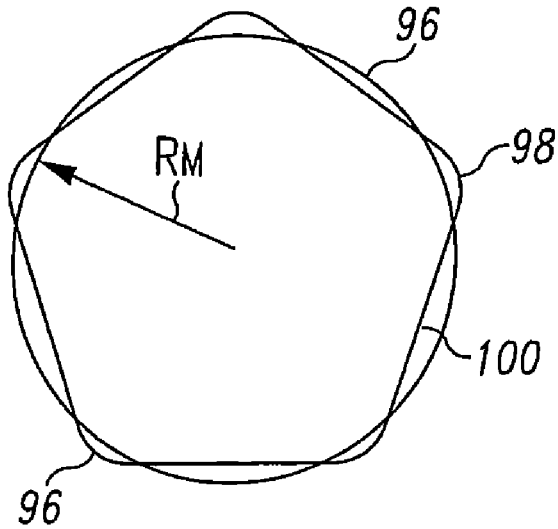
FIG. 8 is a section slice similar to FIG. 4 showing the deformation of the shoulder of a third bottle of the present invention when subjected to post capping vacuum development within the bottle.

The midpoint radius of surface 96 is not required to be manufactured with a variation in radius, although such a variation does enhance the predictability of the shape of the vacuum displaced surface so that the rounded corner square of FIG. 6 can still result. As the average midpoint radius $R_M$ is made proportionally smaller than the example container, and the midpoint radius is maintained essentially constant, the surface 96 will increasingly assume a cross-sectional configuration of a rounded corner triangle as shown in FIG. 7 when subject to a post-capping vacuum. On the other hand, if the average midpoint radius $R_M$ is made proportionally somewhat larger than the example container, and the midpoint radius is maintained essentially constant, the surface 96 can sometimes assume a cross-sectional configuration of a rounded corner pentagon as shown in FIG. 8 when subject to a post-capping vacuum. Any unpredictability in the ultimate configuration may not be considered acceptable is some packaging, but may actually be desirable in some other circumstances. Even where the midpoint radius $R_M$ is maintained constant, the size of that radius should at least equal to $(3/\pi)$ $(\sin \pi/3)$ $(R_1+R_2)$, and no greater than about $(6/\pi)$ $(\sin \pi/6)$ $(R_1+R_2)$ to achieve the desired surface reconfiguration to at least partially compensate for the post capping development of a partial vacuum.

While these features have been disclosed in connection with the illustrated preferred embodiment, other embodiments of the invention will be apparent to those skilled in the art that come within the spirit of the invention as defined in the following claims.

What is claimed is:

1. A blow-molded bottle comprising a base, a side wall having a lower margin joining the base, the side wall extending upward from the base to an upper margin, a shoulder portion extending upward from the sidewall upper margin and inward to a neck surrounding a vertical axis, the neck supporting a finish defining a opening adapted to accept a closure, the shoulder portion adjoining the neck and including a circumferentially continuous outwardly extending upper peripheral margin, an outwardly protruding ring spaced below the upper peripheral margin, and a flexible concave perimeter surface joining the upper peripheral margin to the outwardly protruding ring, the vertical midpoint of the flexible concave perimeter surface having a radius measured from the vertical axis that has an average value that is greater than $(3/\pi)$ $(\sin \pi/3)$ $(R_1+R_2)$, where $R_1$ is the outermost radius of the shoulder upper peripheral margin, and $R_2$ is the radius of the outwardly protruding ring, and the radius varies from the average value by between one and five percent at between three and five positions around the ring perimeter.

2. The blow-molded bottle of claim 1 wherein the entire flexible concave perimeter surface is at a radius measured from the axis that is greater than the outwardly extending upper peripheral margin.

3. The blow-molded bottle of claim 1 wherein the radius of the outwardly protruding ring is greater than the outermost radius of the shoulder upper peripheral margin.

4. The blow-molded bottle of claim 1 wherein the radius of the vertical mid-point of the concave perimeter surface has an average value that is less than $(6/\pi)$ $(\sin \pi/6)$ $(R_1+R_2)$.

5. The blow-molded bottle of claim 1 further comprising an inwardly indented ring joining the upper margin of the side wall to the shoulder portion.

6. The blow-molded bottle of claim 5 wherein the inwardly indented ring has a radius measured from the axis that is about equal to the average radius of the vertical midpoint of the concave perimeter surface.

7. The blow-molded bottle of claim 1 wherein the side wall includes vacuum responsive features.

8. The blow-molded bottle of claim 1 wherein the side wall includes a upper step defining an upper margin of a label panel and a lower step defining a lower margin of the label panel.

9. The blow-molded bottle of claim 8 wherein the label panel portion of the sidewall includes at least one continuous inwardly indented hoop ring.

10. The blow-molded bottle of claim 8 wherein the label panel portion of the sidewall includes at least one discontinuous inwardly indented hoop ring.

11. A blow-molded bottle comprising a base, a side wall having a lower margin joining the base, the side wall extending upward from the base to an upper margin, an inwardly indented ring joining the upper margin of the side wall to a shoulder portion, the shoulder portion extending upward above the inwardly indented ring and inward to a neck surrounding a vertical axis below a finish defining a opening adapted to accept a closure, the shoulder portion including a circumferentially continuous outwardly extending upper peripheral margin adjoining the neck, an outwardly protruding ring immediately above the inwardly indented ring, and a flexible concave perimeter surface joining the upper peripheral margin to the outwardly protruding ring, the entire flexible concave perimeter surface being at a radius measured from the vertical axis that is greater than the outwardly extending upper peripheral margin, the vertical midpoint of the flexible concave perimeter surface having a radius measured from the vertical axis that has an average value that is greater than $(3/\pi)$ $(\sin \pi/3)$ $(R_1+R_2)$, where $R_1$ is the outermost radius of the shoulder upper peripheral margin, and $R_2$ is the radius of the outwardly protruding ring, and the radius varies from the average value by between one and five percent at four equally spaced positions around the ring perimeter.

12. The blow-molded bottle of claim 11 wherein the radius of the vertical mid-point of the concave perimeter surface has an average value that is greater than $(4/\pi)$ $(\sin \pi/4)$ $(R_1+R_2)$.

13. The blow-molded bottle of claim 11 wherein the radius of the vertical mid-point of the concave perimeter surface has an average value that is less than $(6/\pi)$ $(\sin \pi/6)$ $(R_1+R_2)$.

14. The blow-molded bottle of claim 13 wherein $R_1 < R_2$.

15. The blow-molded bottle of claim 14 wherein the side wall includes a upper step defining an upper margin of a label panel, a lower step defining a lower margin of the label panel, and vacuum responsive features located between the upper step and lower step.

16. The blow-molded bottle of claim 15 wherein the label panel portion of the sidewall includes at least one continuous inwardly indented hoop ring situated between the vacuum responsive features and one of the upper and lower label panel margins.

17. A blow-molded bottle comprising a base, a side wall having a lower margin joining the base, the side wall extending upward from the base to an upper margin, an inwardly indented ring joining the upper margin of the side wall to a shoulder portion, the shoulder portion extending upward above the inwardly indented ring and inward to a neck surrounding a vertical axis below a finish defining a opening adapted to accept a closure, the shoulder portion including a circumferentially continuous outwardly extending upper peripheral margin adjoining the neck, an outwardly protruding ring immediately above the inwardly indented ring, and a flexible concave perimeter surface joining the upper peripheral margin to the outwardly protruding ring, the vertical midpoint of the flexible concave perimeter surface having a radius measured from the vertical axis that has an average value, and which radius varies by between one and five percent of the average value at several equally spaced positions around the concave surface perimeter, the shoulder portion responding to the presence of a vacuum within the bottle by forming linear segments between the upper peripheral margin and the outwardly protruding ring coincident with the equally spaced positions.

18. The blow-molded bottle of claim 17 wherein at least an upper wall of the inwardly indented ring joining the upper margin of the side wall to the shoulder portion is vertically wavy and sufficiently vertically flexible to permit the enhancement of the wavy character of the upper wall in response to the presence of a vacuum within the bottle.

19. A blow-molded bottle comprising at least one portion having a circumferentially continuous outwardly extending upper peripheral margin located symmetrically about a vertical axis, an outwardly protruding ring located below the upper peripheral margin, and a flexible concave perimeter surface joining the upper peripheral margin to the outwardly protruding ring, the vertical midpoint of the flexible concave perimeter surface having a radius measured from the vertical axis that has an average value, and which radius varies by between one and five percent of the average value at between three and five spaced positions around the flexible concave perimeter surface, the concave perimeter surface responding to the presence of a vacuum within the bottle by forming linear segments between the upper peripheral margin and the outwardly protruding ring coincident with the spaced positions.

20. A blow-molded bottle comprising at least one portion having a circumferentially continuous outwardly extending upper peripheral margin located symmetrically about a vertical axis at an outermost radius $R_1$, an outwardly protruding ring located below the upper peripheral margin at a radius R2 measured from the vertical axis, and a flexible concave perimeter surface joining the upper peripheral margin to the outwardly protruding ring, the vertical midpoint of the flexible concave perimeter surface having a radius measured from the vertical axis that is greater than $(3/\pi)(\sin \pi/3)(R_1 + R_2)$, and less than $(6/\pi)(\sin \pi/6)(R_1 +_2)$, the concave perimeter surface responding to the presence of a vacuum within the bottle by forming linear segments between the upper peripheral margin and the outwardly protruding ring, the linear segments being separated from each other by concave indented portions.

21. A blow-molded bottle comprising a base, a side wall having a lower margin joining the base, the side wall extending upward from the base to an upper margin, a shoulder portion extending upward from the sidewall upper margin and inward to a neck surrounding a vertical axis, the neck supporting a finish defining a opening adapted to accept a closure, the shoulder portion adjoining the neck and including a circumferentially continuous outwardly extending upper peripheral margin, an outwardly protruding ring spaced below the upper peripheral margin, and a flexible concave perimeter surface joining the upper peripheral margin to the outwardly protruding ring, the vertical midpoint of the flexible concave perimeter surface having a radius measured from the vertical axis that has an average value that is less than $(6/\pi)(\sin \pi/6)(R_1 + R_2)$, where $R_1$ is the outermost radius of the shoulder upper peripheral margin, and $R_2$ is the radius of the outwardly protruding ring, and the radius varies from the average value by between one and five percent at between three and five positions around the ring perimeter.

* * * * *